US009057974B2

(12) United States Patent
Ishihara et al.

(10) Patent No.: US 9,057,974 B2
(45) Date of Patent: Jun. 16, 2015

(54) IMAGE FORMING APPARATUS HAVING PHOTOSENSITIVE MEMBER EXPOSED TO PLURAL BEAMS, AND CONTROL APPARATUS FOR LIGHT SOURCE OF IMAGE FORMING APPARATUS

(71) Applicant: CANON KABUSHIKI KAISHA, Tokyo (JP)

(72) Inventors: Takahiro Ishihara, Maebashi (JP); Tomohisa Itagaki, Abiko (JP); Nobuhiko Zaima, Kashiwa (JP); Yasuhito Shirafuji, Kashiwa (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 13/940,673

(22) Filed: Jul. 12, 2013

(65) Prior Publication Data

US 2014/0036020 A1 Feb. 6, 2014

(30) Foreign Application Priority Data

Jul. 31, 2012 (JP) ..... 2012-169589

(51) Int. Cl.
*G03G 15/043* (2006.01)

(52) U.S. Cl.
CPC ..... *G03G 15/043* (2013.01); *G03G 15/0435* (2013.01)

(58) Field of Classification Search
CPC ..... G02B 26/123; G03G 15/043; B41J 2/385
USPC ..... 347/224, 233, 238
See application file for complete search history.

(56) References Cited

U.S. PATENT DOCUMENTS 5,724,087 A * 3/1998 Sugano et al. ..... 347/243
2011/0298884 A1* 12/2011 Furuta ..... 347/224

FOREIGN PATENT DOCUMENTS

JP 08146328 A * 6/1996
JP 2008-116664 A 5/2008

* cited by examiner

*Primary Examiner* — Sarah Al Hashimi
(74) *Attorney, Agent, or Firm* — Rossi, Kimms & McDowell LLP

(57) ABSTRACT

An image forming apparatus capable of suppressing density unevenness of a toner image formed on a photosensitive member. A light amount of a light beam that exposes an end portion of the photosensitive member is made different from a light amount of a light beam that exposes a central portion thereof in order to suppress a density difference between a toner image density at the central portion of the photosensitive member and that at the end portion thereof in a scanning direction of the light beams.

10 Claims, 12 Drawing Sheets

IMAGE FORMING APPARATUS HAVING PHOTOSENSITIVE MEMBER EXPOSED TO PLURAL BEAMS, AND CONTROL APPARATUS FOR LIGHT SOURCE OF IMAGE FORMING APPARATUS

BACKGROUND OF THE INVENTION

1. Field of the Invention

The present invention relates to an image forming apparatus that has a photosensitive member exposed to plural beams, and a control apparatus for a light source of the image forming apparatus.

2. Description of the Related Art

In electrophotographic type image forming apparatuses, a laser light beam is irradiated onto a uniformly charged photosensitive member to form an electrostatic latent image thereon, the electrostatic latent image is developed to form a toner image on the photosensitive member, and the toner image is transferred and fixed to a recording medium for image formation on the recording medium.

Some of such image forming apparatuses have a rotary polygonal mirror having plural reflection surfaces, and cause plural laser light beams to enter the same reflection surface of the rotary polygonal mirror, and scan the photosensitive member with the light beams deflected by the reflection surface and passing through lenses such as fθ lenses. Hereinafter, a scanning direction of the light beams on the photosensitive member will be referred to as the main scanning direction.

In such an image forming apparatus, the photosensitive member is exposed with the plural laser light beams (deflected by one reflection surface of the rotary polygonal mirror) at predetermined intervals in a rotating direction of the photosensitive member, i.e., in a sub-scanning direction. Accordingly, plural scanning lines can be formed on the photosensitive member during one scan cycle, whereby image formation can be performed at high speed.

However, there is a case where the reflection surfaces of the rotary polygonal mirror have slightly different angles relative to a rotation axis of the mirror, and optical paths of light beam reflected by different reflection surfaces become different from one another due to differences between the reflection surface angles. In that case, an interval between upstream-most one of exposure positions of the light beams (deflected by one reflection surface of the rotary polygonal mirror) on the photosensitive member in the rotating direction of the photosensitive member and downstream-most one of exposure positions of the light beams (deflected by the next reflection surface of the mirror) in the rotating direction of the photosensitive member does not become equal to an interval between adjacent ones of exposure positions of plural light beams deflected by one reflection surface of the mirror.

Due to unevenness of the interval between exposure positions of light beams, density unevenness occurs in a toner image in the rotating direction of the photosensitive member. Thus, there has been disclosed an image forming apparatus that controls light amounts of light beams on a per reflection surface basis to thereby prevent density unevenness (see, for example, Japanese Laid-open Patent Publication No. 2008-116664).

However, exposure positions of light beams vary under influence of characteristics of lenses such as fθ lenses disposed on optical paths between the rotary polygonal mirror and the photosensitive member.

FIG. 1 shows a result of measurement of exposure positions of plural light beams.

In the measurement to obtain the illustrated measurement result, an image forming apparatus was used that is configured such that images of first to sixteenth laser light beams deflected by one of reflection surfaces of a rotary polygonal mirror are formed on a surface of a photosensitive member at intervals corresponding to resolution of 2400 dpi, and exposure positions of the first to sixteenth laser light beams were measured by using an array type CCD sensor.

In FIG. 1, black circles represent the exposure positions of the first to sixteenth light beams on the center and both ends of the photosensitive member (main scan image heights, i.e., positions on a surface of the photosensitive member where laser light images are formed). It should be noted that illustrations of exposure positions of the light beams on the remaining portions of the photosensitive member are omitted. A fine curved line extending horizontally at an upper part of FIG. 1 represents a scanning line (scanning locus) of the first light beam on the photosensitive member, fine straight lines extending horizontally at a central part of FIG. 1 represent scanning lines of the eighth and ninth light beams, and a fine curved line extending horizontally at a lower part of FIG. 1 represents a scanning line of the sixteenth light beam. It should be noted that illustrations of scanning lines of the second to seventh light beams and those of the tenth to fifteenth light beams are omitted.

It is preferable that intervals between exposure positions of adjacent light beams at respective positions in the main scanning direction be uniform. However, since the incident position to lenses is different between respective light beams, lens aberrations at respective incident positions are slightly different from one another. As a result, the scanning lines are curved as shown in FIG. 1, and intervals between light beams at each end portion of the photosensitive member in the main scanning direction become smaller than intervals between light beams at a central portion of the photosensitive member in the main scanning direction. Generally, each lens has a higher optical performance at parts closer to its optical axis. In other words, scanning lines of light beams entering at positions of the lens remoter from the optical axis (i.e., scanning lines of the first and sixteenth light beams in the example of FIG. 1) are more noticeably curved. It should be noted that the scanning lines can be curved in a direction opposite from the curved direction shown in FIG. 1 depending on lens characteristics. If intervals between scanning lines (exposure intervals) vary depending on the position in the main scanning direction, density unevenness occurs in a toner image.

SUMMARY OF THE INVENTION

The present invention provides an image forming apparatus capable of suppressing density unevenness of a toner image formed on a photosensitive member, and provides a control apparatus for a light source of the image forming apparatus.

According to one aspect of this invention, there is provided an image forming apparatus comprising a light source configured to emit a first beam that exposes a rotating photosensitive member and emit a second beam that exposes a position different from that exposed by the first beam in a direction of rotation of the photosensitive member, a deflection unit configured to deflect the first and second beams emitted from the light source such that the first and second beams scan the photosensitive member, a lens configured to guide the first and second beams deflected by the deflection unit to the photosensitive member, an image forming unit configured to develop an electrostatic latent image formed on the photosensitive member by being exposed to the first and second beams into a toner image, and a control unit configured to make a light amount of the second beam that passes through the lens and exposes a central portion of the photosensitive member different from a light amount of the second beam that exposes an end portion of the photosensitive member in order to suppress a density difference between a toner image density at the central portion of the photosensitive member and that at the end portion thereof in a direction in which the first and second beams scan the photosensitive member.

With this invention, it is possible to suppress density unevenness of a toner image formed on the photosensitive member.

Further features of the present invention will become apparent from the following description of an exemplary embodiment with reference to the attached drawings.

DESCRIPTION OF THE EMBODIMENTS

The present invention will now be described in detail below with reference to the drawings showing a preferred embodiment thereof.

Figure 2:
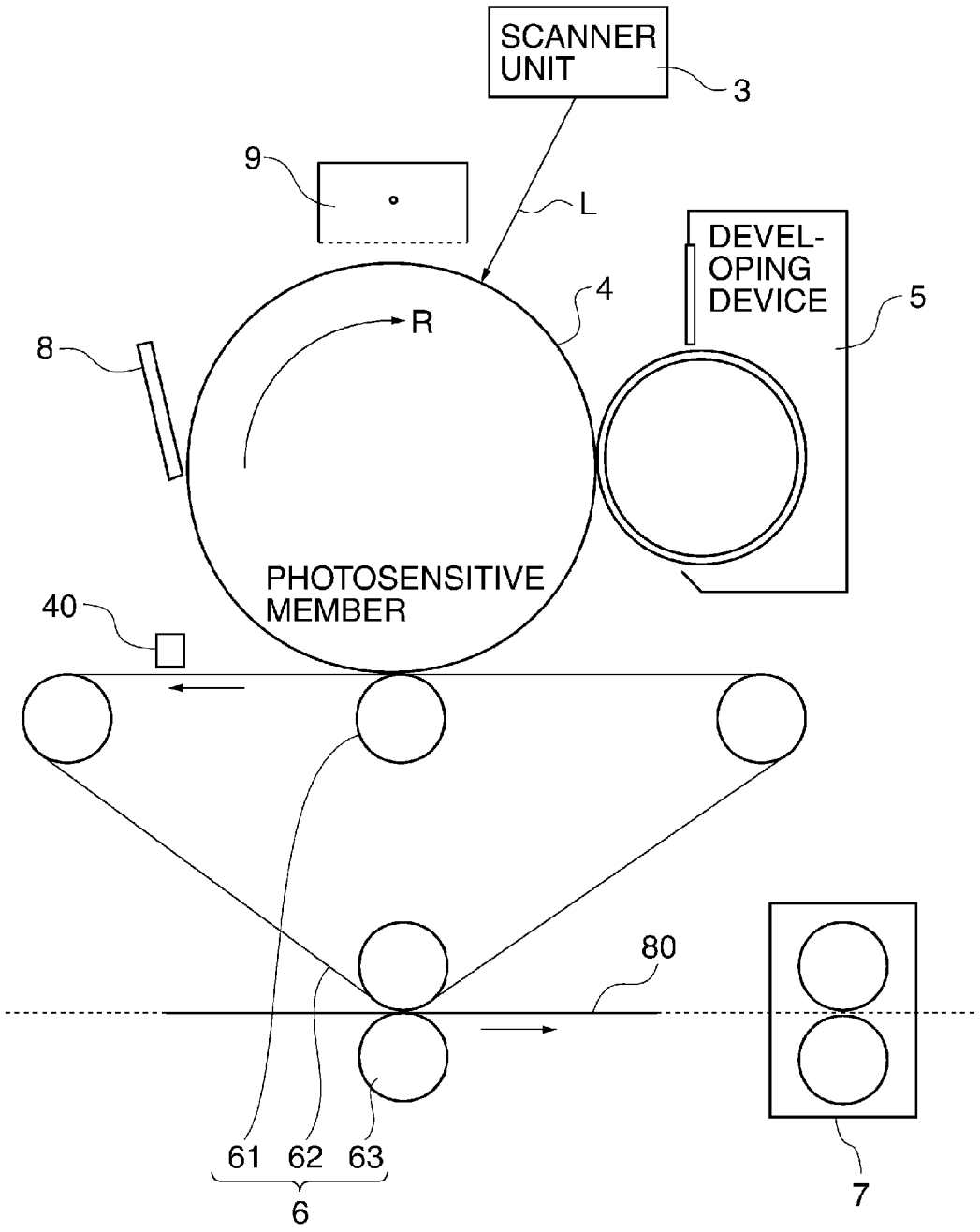
FIG. 2 is a view schematically showing the construction of an image forming unit of an image forming apparatus according to one embodiment of this invention.

FIG. 2 schematically shows the construction of an image forming unit of an image forming apparatus according to one embodiment of this invention. The image forming unit constitutes a primary part of an engine unit (shown by reference numeral 2 in FIG. 10) of the image forming apparatus. Although a monochrome image forming apparatus will be described by way of example in this embodiment, the present invention is also applicable to a color image forming apparatus having photosensitive drums for respective colors.

In FIG. 2, reference numeral 4 denotes a photosensitive member, e.g., a photosensitive drum. The photosensitive drum 4 is rotatably driven by a drive source (not shown) in a direction of arrow R, and is charged by a charging device 9. The photosensitive drum 4 is scanned with laser light L (light beams) generated by a scanner unit 3 based on an image signal and output from the scanner unit 3, whereby an electrostatic latent image corresponding to the image signal is formed on the photosensitive drum 4.

The electrostatic latent image formed on the photosensitive drum 4 is developed by a developing device 5 to a toner image, and transferred by a primary transfer roller 61 from the photosensitive drum 4 to an intermediate transfer belt 62 and transferred by a secondary transfer roller 63 from the intermediate transfer belt 62 to a recording medium 80.

The toner image transferred to the recording medium 80 is fixed to the recording medium 80 by a fixing device 7. Residual toner on the photosensitive drum 4 is scraped off by a cleaner 8 and conveyed to a waste toner container (not shown) for recovery.

Various parts of the image forming unit operate under the control of a controller (shown by reference numeral 11 in FIG. 10) of the image forming apparatus. For example, transmission of image data to the scanner unit 3 is controlled by the controller 11.

A patch detection sensor 40 is disposed facing the intermediate transfer belt 62, detects the density of a patch pattern (patch image) formed on the intermediate transfer belt 62, and transmits to the controller 11 an output signal representing the density of patch pattern. The controller 11 controls adjustment of the amount of light emitted from the scanner unit 3 such that the density of image becomes a target density.

Figure 3:
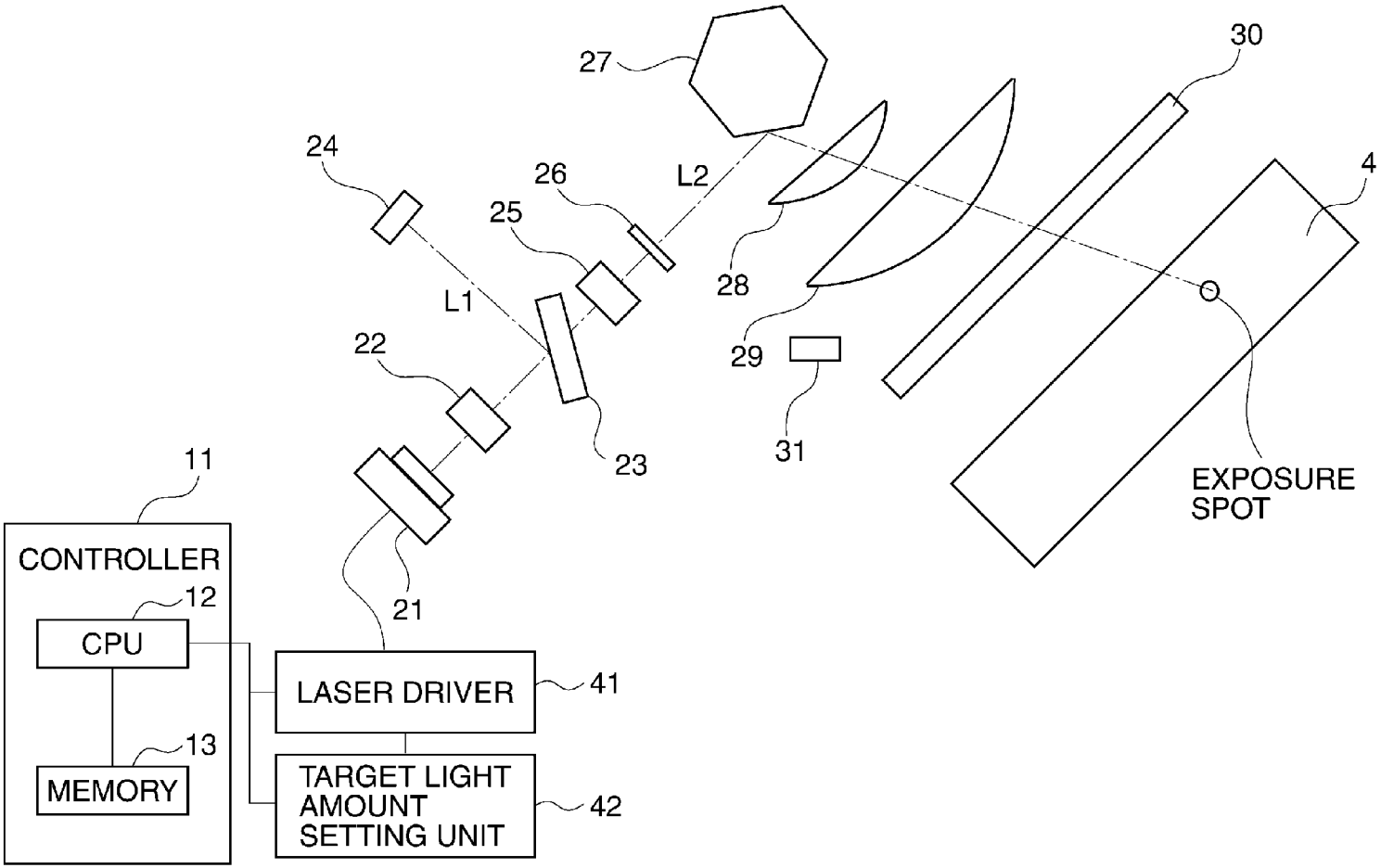
FIG. 3 is a view schematically showing the construction of a scanner unit of the image forming unit.

FIG. 3 schematically shows the scanner unit 3.

The scanner unit 3 includes a laser light source, e.g., a surface emission laser element 21 that has a plurality of (e.g., 16) laser emitting points arranged so as to expose different positions on the photosensitive drum 4 in the direction of drum rotation and that emits sixteen laser light beams.

These laser light beams emitted from the surface emission laser element 21 are made parallel by a collimator lens 22. Each laser beam L is split into two laser beams L1, L2 by a half mirror 23. The laser beam L1 enters a photodiode 24. The laser beam L2 passing through the half mirror 23 and through a cylinder lens 25 is shaped in cross section by an aperture 26 and enters a rotary polygonal mirror 27.

The rotary polygonal mirror 27 has a plurality of (e.g., six) reflection surfaces and is rotatably driven by a drive motor (not shown). Sixteen light beams deflected by the same reflection surface of the rotary polygonal mirror 27 and passing through fθ lenses 28, 29 and through a reflection mirror 30 scan (expose) different positions on the photosensitive drum in the direction of drum rotation.

A beam detector 31 is disposed on a scanning line of at least one of the sixteen light beams, and generates a sync signal in response to incidence of light beam. According to the image signal, the laser emitting points of the surface emission laser element 21 emit laser light beams at a timing determined based on the generation timing of the sync signal.

The scanning lines of laser light beams L2 are curved due to characteristics of lenses, such as fθ lenses 28, 29, which are disposed on optical paths of the laser light beams extending between the rotary polygonal mirror 27 and the photosensitive drum 4. Degrees of curvature of the scanning lines of the laser beams L2 are different from one another since the laser beams L2 pass through different positions of the lenses. As a result, a density difference is produced in toner image (more generally, image) between an end portion and a central portion thereof in the main scanning direction. The density difference is a cause of moire in image.

It should be noted that a toner image (dot or line) is formed at a screen angle in the main scanning direction. In recent years, image formation is performed at various screen angles to improve the quality of image. Even in that case, it is preferable that no moire be produced irrespective of screen angle.

Next, a description will be given of a cause of moire.

As previously described, images of sixteen laser light beams deflected by one reflection surface of the rotary polygonal mirror 27 are formed on different positions of the photosensitive drum 4 in the drum rotation direction (sub-scanning direction). In the following, the sixteen light beams will be referred to as the beam group, and six beam groups deflected by the six reflection surfaces of the rotary polygonal mirror 27 will be referred to as the first to sixth beam groups.

Figure 4:
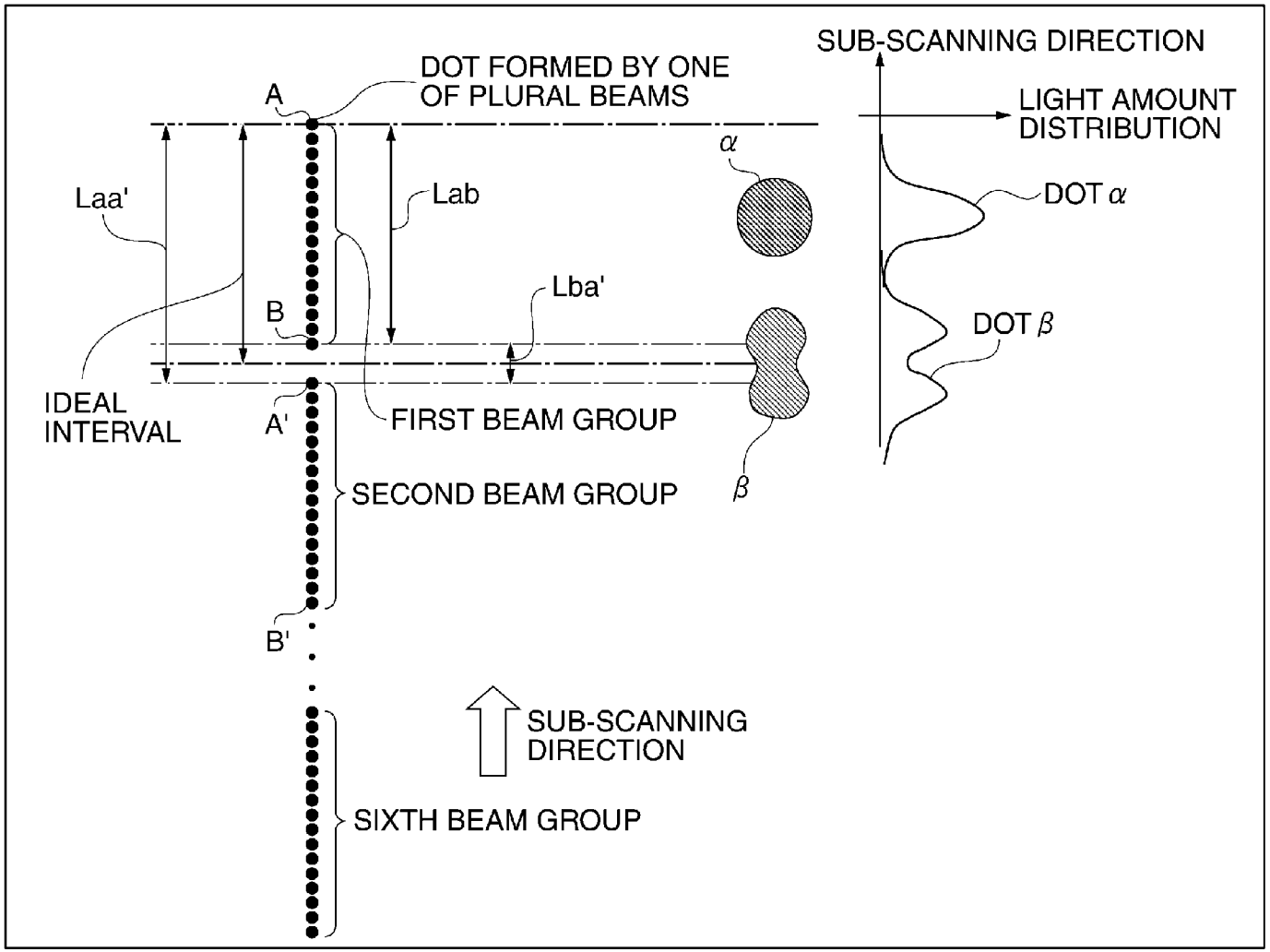
FIG. 4 is a view showing dots formed on a photosensitive member scanned with plural beams.

In FIG. 4, black circle marks each denote the center of mass of a corresponding one of beams (more specifically, the center of mass of one of dots of a dot string formed by beam scan). Symbols A, B denote the first and last beams of the first beam group, respectively. Symbols A' and B' denote the first and last beams of the second beam group, respectively.

In the following, an interval between scans of corresponding ones of the beams of adjacent beam groups (e.g., interval between scan of the first beam A of the first beam group and scan of the first beam A' of the second beam group) will be referred to as the interval between scans, and an interval in sub-scanning direction corresponding to the interval between scans will be denoted by symbol Laa'. An interval between scans of the first and last beams of each beam group (e.g., interval between scans of the first and last beams A, B of the first beam group) will be referred to as the sub-scanning interval between beams, and an interval in the sub-scanning direction corresponding to the sub-scanning interval between beams will be denoted by a symbol Lab. A scan interval between adjacent beam groups (e.g., interval between scan of the last beam B of the first beam group and scan of the first beam A' of the second beam group) will be referred to as the interval between adjacent beam groups, and an interval in the sub-scanning direction corresponding to the interval between adjacent beam groups will be denoted by a symbol Lba'.

The sub-scanning interval between beams, Lab, becomes wider or narrower depending on lens aberration. If the sub-scanning interval between beams, Lab, becomes narrower (or wider), the interval between adjacent beam groups, Lba', becomes wider (or narrower).

The interval between scans, Laa', is decided by the rotational speed of the rotary polygonal mirror 27 and that of the photosensitive drum 4. In other words, if both the rotational speeds of the rotary polygonal mirror 27 and the photosensitive drum 4 are ideal, the interval between scans, Laa', becomes an ideal interval.

Figure 1:
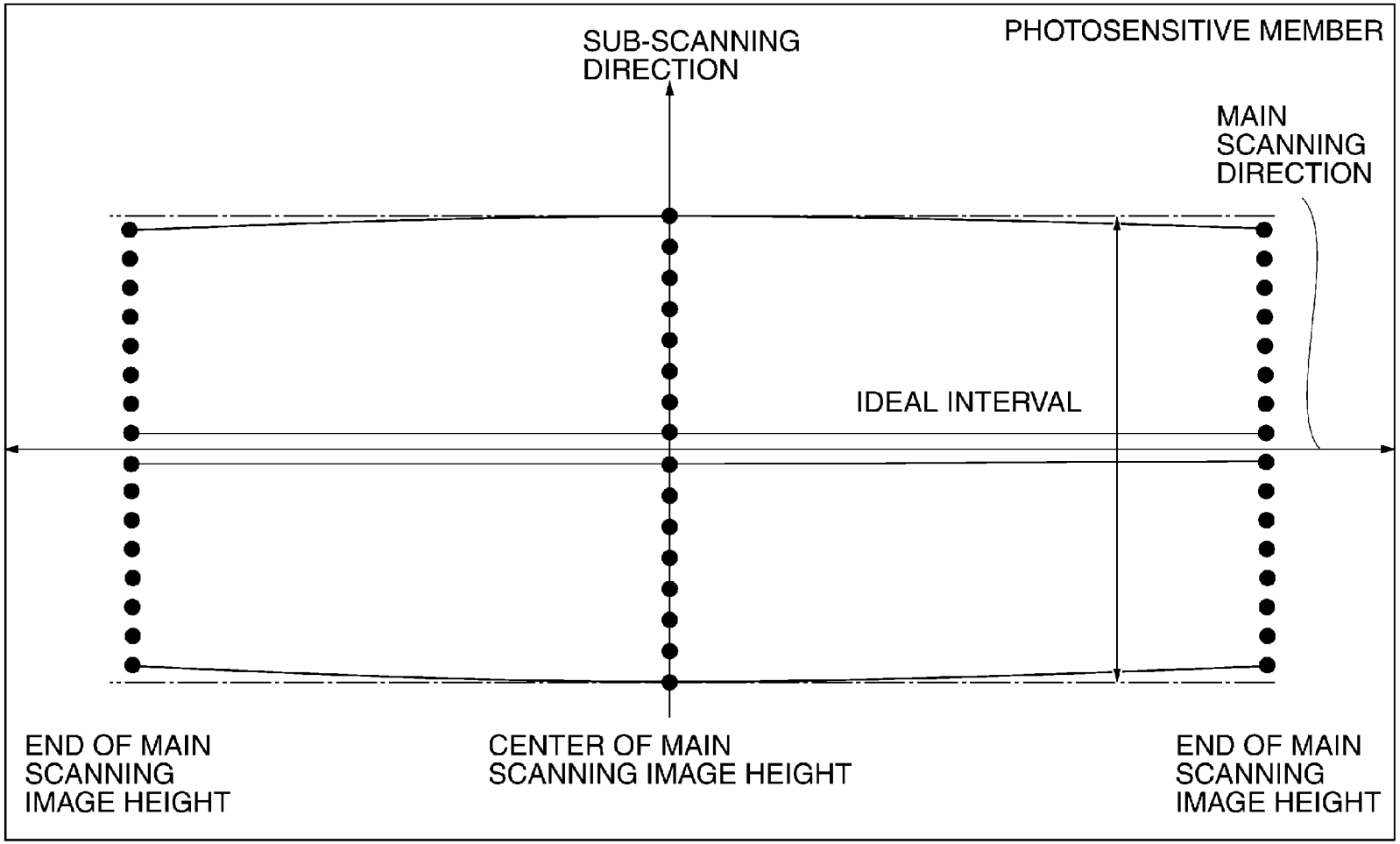
FIG. 1 is a view showing a result of measurement of exposure positions of plural light beams and showing how an interval between beams in a sub-scanning direction changes in a main scanning direction.

Depending on optical characteristics of lenses, the sub-scanning interval between beams, Lab, sometimes varies in the main scanning direction. In the example shown in FIG. 1, the sub-scanning interval between beams, Lab, at each end portion of the photosensitive drum 4 in the main scanning direction (i.e., at each end of main scan image height) is narrower than that at a central portion thereof in the main scanning direction (i.e., at the center of main scan image height).

In FIG. 4, a dot α is formed by exposure to intermediate beams that are located between the beams A and B, whereas a dot β is formed straddling the beams B and A'. Since there is a vacancy between the beams B and A', a peak light amount of the beams that expose the dot β is smaller than a peak light amount of the beams that expose the dot α, and therefore the density of the dot β becomes lighter than that of the dot α. Due to a density difference between the densities of the dots α and β, a periodic density unevenness is produced.

It should be noted that the dot α corresponds to a dot formed at an ideal position where there is no deviation between plural beams, whereas the dot β corresponds to a dot formed at a position where there is a deviation between plural beams.

A repetition cycle of dots α, β corresponds to a cycle of density unevenness. Since an interval between dots varies depending on a cycle in a screen, the cycle of density unevenness becomes longer than a cycle of the interval between scans, Laa', and longer than the cycle in the screen. In the following, a description will be given of this point with reference to FIG. 5.

Figure 5:
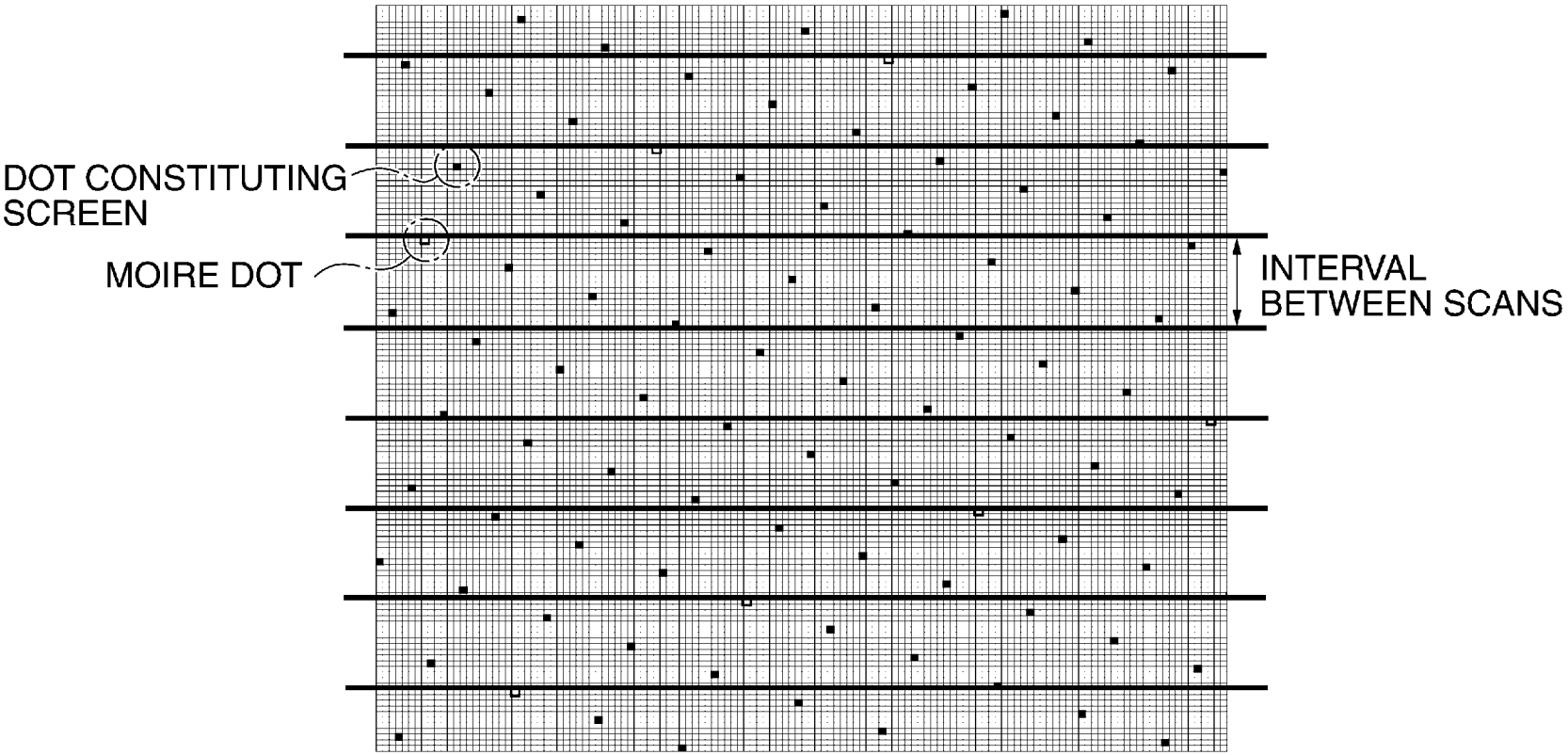
FIG. 5 is a view showing moire produced by the overlap of a cycle in a screen with a cycle of an interval between scans.

In FIG. 5, black rectangular marks represent the centers of mass of dots that constitute the screen. The dots represented by black rectangular marks each correspond to the dot α. White rectangular marks each represent a dot where the cycle in the screen overlaps the cycle of the interval between scans, Laa'. The dots represented by the white rectangular marks each correspond to the dot β located between adjacent beam groups. Bold lines extending parallel to the main scanning direction represent a cycle of scans by the rotary polygonal mirror.

The cycle of dots represented by white rectangle marks is a cycle of overlap of the cycle in the screen with the cycle of the interval between scans, Laa' (i.e., cycle of overlap of bold line with dots constituting the screen and indicated by black rectangle marks in FIG. 5). Density unevenness is produced by the overlap of the cycle in the screen with the cycle of the interval between scans, Laa'. The cycle of density unevenness becomes longer than the cycle in the screen and longer than the cycle of the interval between scans, Laa'.

As described above, long interval density unevenness (moire) easily visible by human eyes is produced by the overlap of the cycle in the screen with the cycle of the interval between scans, Laa'. If the cycle of the interval between scans, Laa', becomes longer, i.e., if the number of beams increases, the interval between bold lines in FIG. 5 becomes wider, and the cycle of dots indicated by white rectangle marks in FIG. 5 becomes longer. As a result, the interval of density unevenness, i.e., the interval of moire, becomes long and easily visible by human eyes.

It should be noted that although a case where the sub-scanning interval between beams, Lab, becomes narrower has been described, a case where the interval Lab becomes wider is the same as the above-described case except that the density of dot β becomes darker than the density of dot α, and therefore a description thereof will be omitted.

Next, a description will be given of influences of the amount of deviation of sub-scanning interval between beams, Lab, from ideal interval on density unevenness with reference to FIG. 6.

Figure 6:
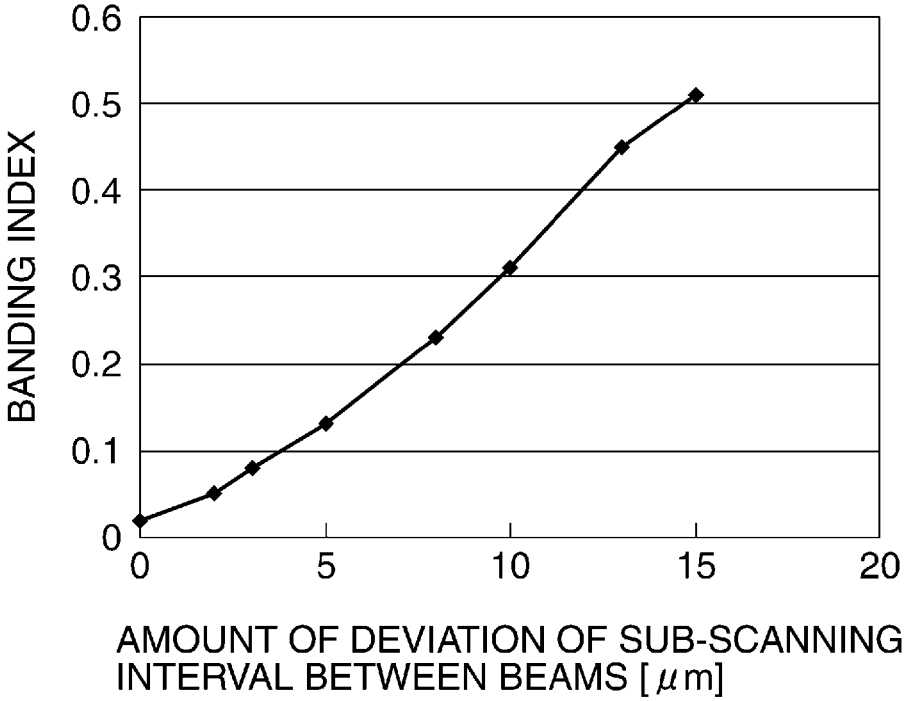
FIG. 6 is a graph showing a relationship between an amount of deviation of a sub-scanning interval between beams from an ideal interval and a banding index.

FIG. 6 shows a relationship between the amount of deviation of a sub-scanning interval between beams from an ideal interval and a banding index. In FIG. 6, the amount of deviation of the sub-scanning interval between beams, Lab, from an ideal interval is taken along abscissa, and the banding index representing a level of density unevenness is taken along ordinate.

The banding index is calculated, for example, as follows. Image data is converted from a RGB value into a color value, and a brightness component is extracted from the image data of color value to obtain brightness data. Then, the brightness data is Fourier transformed to obtain spatial frequency spectrum, and the spatial frequency spectrum is multiplied by a visual transfer function VTF, whereby the calculation is completed.

Density unevenness becomes visible by human eyes when the banding index has an absolute value of about 0.1, and is visually identified when the banding index has an absolute value larger than 0.3. Density unevenness cannot be visually identified when an amount of deviation of the sub-scanning interval between beams, Lab, from the ideal interval is less than or equal to 3 μm, becomes visible when the deviation amount exceeds 5 μm, and is visually identified as moire when the deviation amount has a value of about 10 μm.

Next, a description will be given of a method for measuring a profile of sub-scanning intervals between beams at main scan image heights.

Figure 7A:
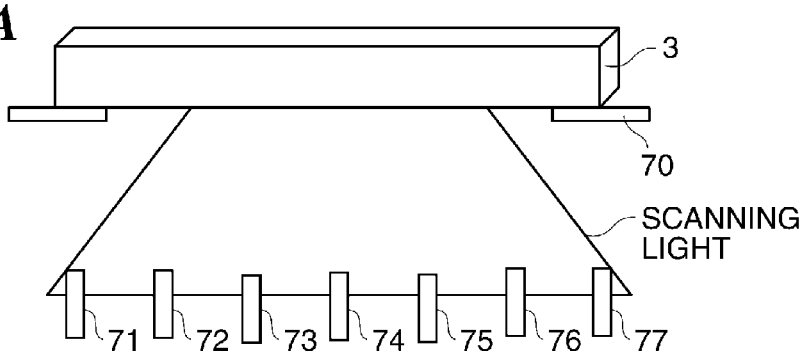
FIG. 7A is a view schematically showing the construction of a measurement apparatus for measuring intervals between exposure positions of light beams.

FIG. 7A schematically shows the construction of a measurement apparatus for measuring intervals between exposure positions of laser light beams.

The measurement apparatus has a stationary base 70 on which the scanner unit 3 is installed and array type CCD sensors 71 to 77 that are disposed relative to the scanner unit 3 installed on the stationary base 70 at a position corresponding to a position where the photosensitive drum of the image forming apparatus is installed. The CCD sensors 71 to 77 are disposed at different positions in the main scanning direction respectively corresponding to from one end to another end of the photosensitive drum in the main scanning direction. These CCD sensors, each constituted by fifty light-receiving elements having 4 μm diameter and disposed one-dimensionally, are disposed parallel to a direction corresponding to the rotating direction of the photosensitive drum (sub-scanning direction) and capable of detecting exposure positions of laser light beams in the sub-scanning direction.

In the measurement apparatus, a driving current is supplied from a power source (not shown) to the surface emission laser element 21 of the scanner unit 3 to cause the laser element 21 to emit sixteen light beams (the first to sixteenth light beams), thereby irradiating the light beams onto the CCD sensors 71 to 77 via the rotary polygonal mirror 27 and lenses of the scanner unit 3. As a result, the CCD sensors 71 to 77 are scanned with the first to sixteenth light beams, and exposure positions of the first to sixteenth light beams on respective ones of the CCD sensors 71 to 77 are measured by these sensors. Based on the exposure positions of the first and sixteenth light beams measured by each CCD sensor, an interval between the exposure positions of the first and sixteenth light beams (i.e., sub-scanning interval between beams) at the position of each CCD sensor in the main scanning direction can be determined, and an amount of deviation of the sub-scanning interval between beams from an ideal interval between the exposure positions can be determined.

Figure 7B:
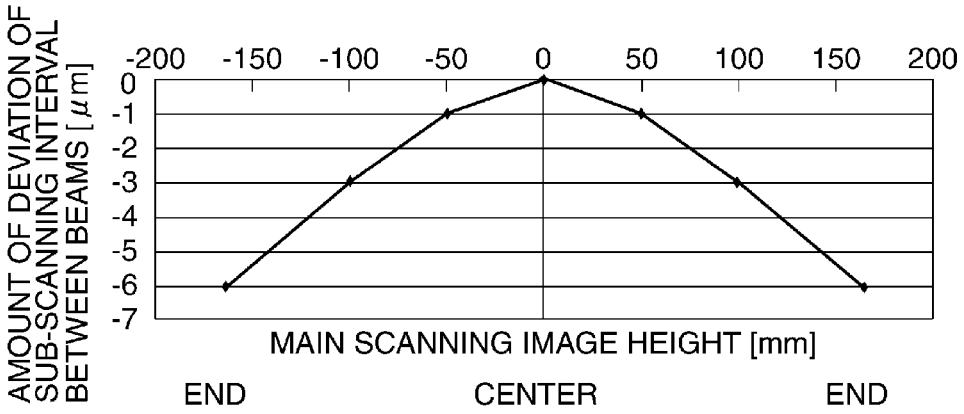
FIG. 7B is a graph showing an example of measurement of amounts of deviation (at plural positions in main scanning direction) of a sub-scanning interval between beams from an ideal interval.

FIG. 7B shows amounts of deviation (at plural positions in the main scanning direction) of the sub-scanning interval between beams from the ideal interval between exposure positions.

Since the CCD sensor 74 disposed at the position corresponding to the central portion of the photosensitive drum in the main scanning direction (i.e., at the center of main scan image height) is less susceptible to influence of lens aberration, the amount of deviation of the sub-scanning interval between beams from the ideal interval between exposure positions at the center of main scan image height is less than −1 μm, as shown in FIG. 7B.

However, the amount of deviation of the sub-scanning interval between beams from the ideal interval between exposure positions increases up to about −6 μm toward each end of main scan image height corresponding to the position where the CCD sensor 71 or 77 is installed from the center of main scan image height corresponding to the position where the CCD sensor 74 is installed.

In light of the relationship shown in FIG. 6 between the amount of deviation of the sub-scanning interval between beams, Lab, and the banding index, density unevenness cannot be visually confirmed at the center of main scan image height, but can be visually confirmed by human eyes at other portions since it increases toward each end portion of main scan image height.

Figure 7C:
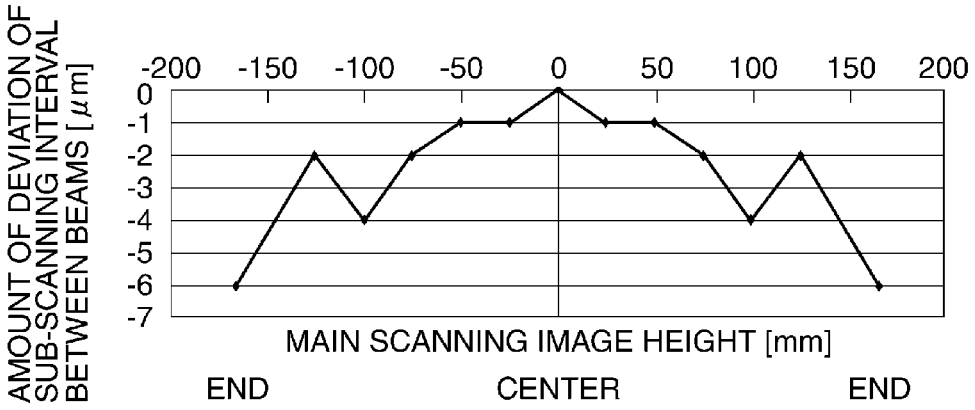
FIG. 7C is a graph showing another example of measurement of the amounts of deviation of the sub-scanning interval between beams from the ideal interval for a case where lens characteristics are different from those in the example measurement of FIG. 7B.

It should be noted that depending on characteristics of lenses that are used for measurement of interval between exposure positions, the amount of deviation of the sub-scanning interval between beams, Lab, from the ideal interval sometimes exhibits a more complicated profile as shown in FIG. 7C. Even in such a case, it is possible to measure data nearly reflecting true lens characteristics by increasing the number of measurement points by increasing the number of CCD sensors disposed in the main scanning direction.

Next, a description will be given of a method for correcting density unevenness caused by the deviation of the sub-scanning interval between beams from the ideal sub-scanning interval. In particular, there will be described a method for correcting density unevenness by changing light amounts of plural beams based on a result of measurement of a profile of sub-scanning intervals between beams, Lab, at main scan image heights.

In this example, it is assumed that a light amount of the last beam of each beam group (e.g., the beam B in FIG. 4), which will be referred to as the to-be-corrected beam, is corrected. In table 1, there is shown a relationship between amounts of deviation of the sub-scanning interval between beams, Lab, from the ideal sub-scanning interval and an amount of correction for light amount of to-be-corrected beam. The amounts of correction for light amount of beam shown in table 1 were computed by a simulator that calculates electrical potential distribution on a surface of the photosensitive drum.

TABLE 1

| Amount of deviation (μm) of sub-scanning interval between beams from ideal sub-scanning interval | Amount of correction for light amount of to-be-corrected beam |
|---|---|
| 2 | 1.05 |
| 4 | 1.3 |
| 6 | 1.5 |
| 8 | 2.0 |

Figure 8:
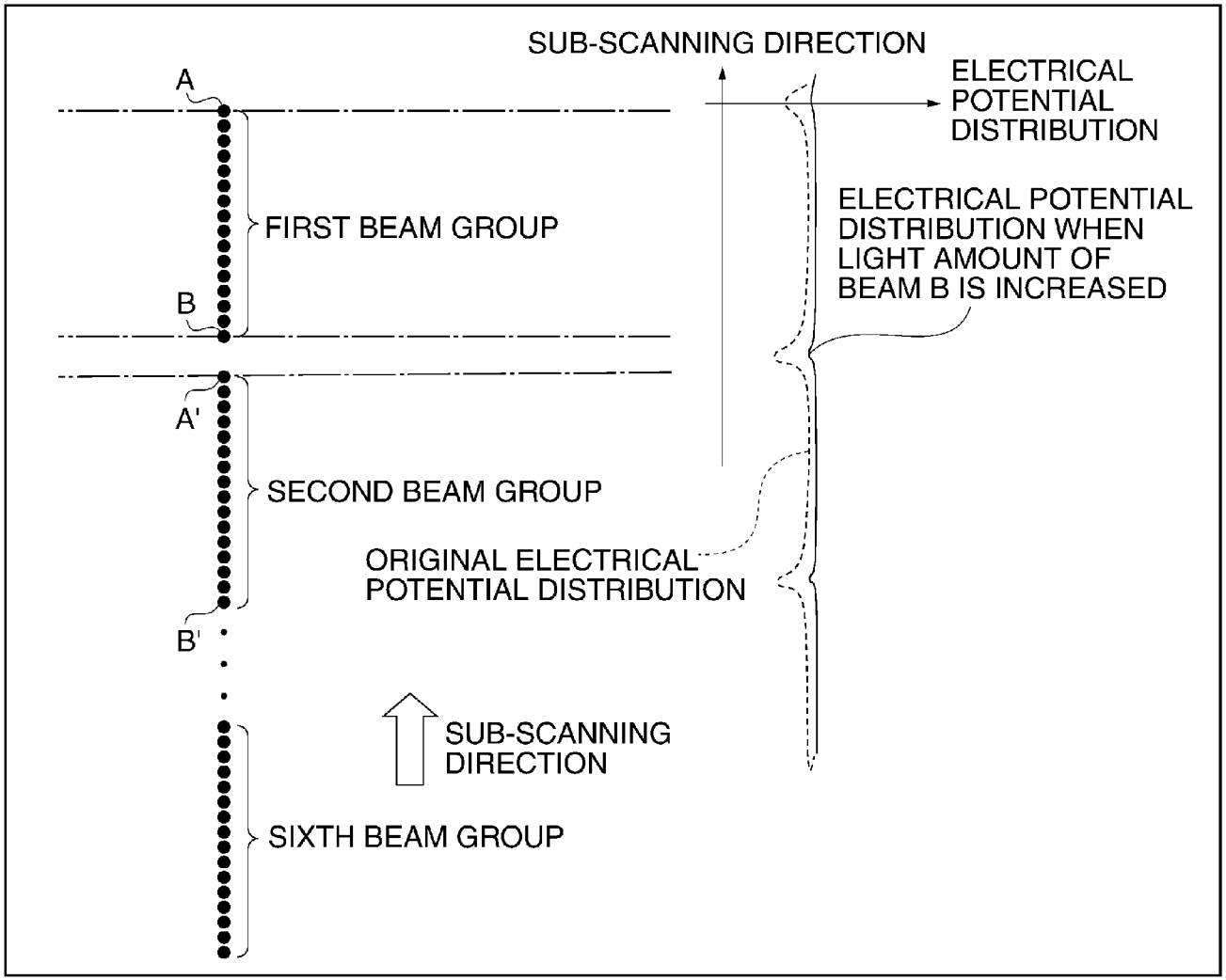
FIG. 8 is a view showing scan positions in the sub-scanning direction where the photosensitive drum is scanned with plural beams, and showing electrical potential distribution in an electrostatic latent image formed by the plural beams.

FIG. 8 shows scan positions in the sub-scanning direction where the photosensitive drum is scanned with plural beams, and shows electrical potential distribution in an electrostatic latent image formed by the plural beams.

If the sub-scanning interval between beams, Lab, is deviated from the ideal sub-scanning interval, the electrical potential distribution largely changes between adjacent beam groups (e.g., between the beams B and A'), as shown in FIG.

8. To make the electrical potential distribution to be close to the ideal electrical potential distribution, an amount of exposure of the last beam of each beam group (e.g., beam B) is corrected with the amount of correction for light amount of to-be-corrected beam.

Figure 9:
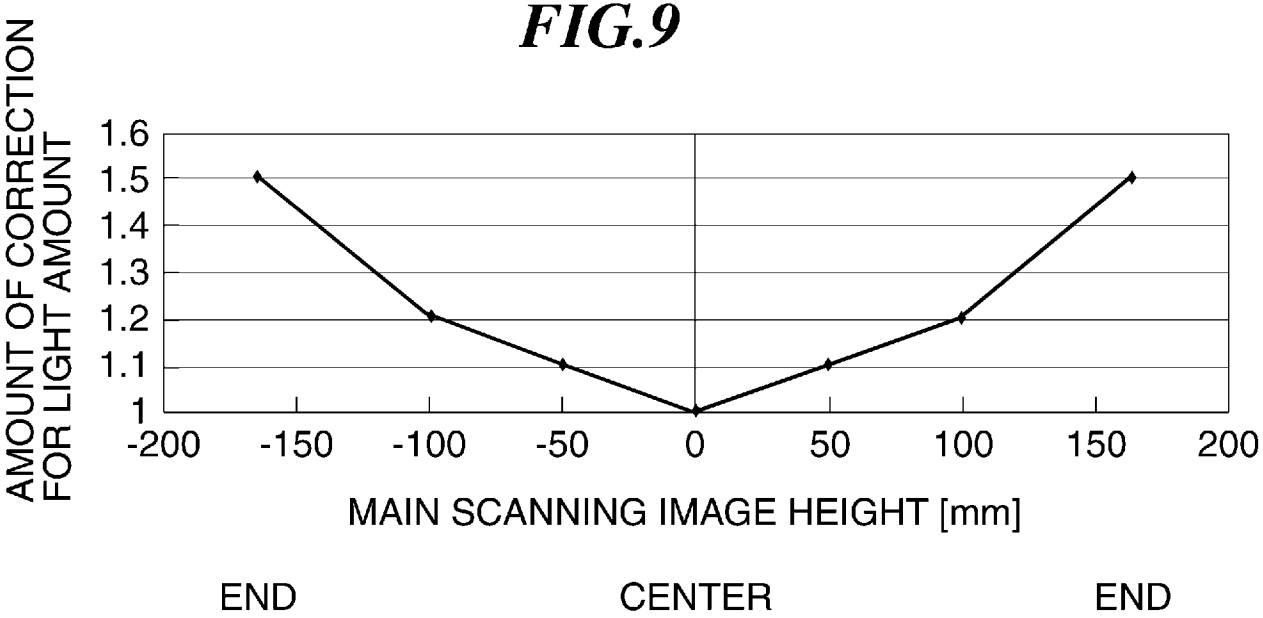
FIG. 9 is a graph showing an example of amounts of correction for light amount of a to-be-corrected beam at main scan image heights.

The amount of correction for light amount of beam indicates what times as large as the light amount of each of fifteen non-to-be-corrected beams (which is represented by a value of 1.0) the light amount of the to-be-corrected beam is. In FIG. 9, there is shown an example of amounts of correction for light amount of the to-be-corrected beam at main scan image heights. These amounts of correction are used when amounts of deviation of the sub-scanning interval between beams, Lab, from the ideal sub-scanning interval at main scan image heights are equal to those shown in FIG. 7B. The amounts of correction for light amount shown in FIG. 9 are determined in advance based on the relationship shown in Table 1 and stored into the memory 13 of the controller 11. Then, referring to the amounts of correction for light amount shown in FIG. 9, a target light amount of the non-to-be-corrected beams and a target light amount of the to-be-corrected beam are decided.

The amounts of correction for light amount shown in FIG. 9 indicate amounts of correction for light amount at seven points of main scan image height. Amounts of correction for light amount at positions in main scanning direction other than the seven points are decided by an interpolation computation performed by the CPU 12 of the controller 11 at e.g. every 1 mm of the main scan image height.

In this embodiment, the last beam (e.g. beam B) of each beam group is used as the to-be-corrected beam, and the light amount of the to-be-corrected beam is corrected. However, instead of the last beam of each beam group, the first beam or the first and last beams or beams near the first and last beams of each beam group can be used as the to-be-corrected beam (s) since the density unevenness is caused by a deviation of the sub-scanning interval between beams (e.g., interval between the beams A and B) from the ideal sub-scanning interval. In that case, the light amount of the to-be-corrected beam is corrected as with the case where the last beam of each beam group is used as the to-be-corrected beam. Alternatively, plural beams of one side of each beam group in the sub-scanning direction and plural beams of another side thereof in the sub-scanning direction can be selected as the to-be-corrected beams, and light amounts of these to-be-corrected beams can be controlled based on a curved profile of scanning lines of light beams.

It should be noted that although the light amount correction for a case where the sub-scanning interval between beams, Lab, is narrower than the ideal sub-scanning interval has been described in this embodiment, light amounts can be corrected in the same manner even in a case where the sub-scanning interval between beams, Lab, is wider than the ideal sub-scanning interval. In that case, the amount of correction for light amount of the to-be-corrected beam is set to be less than one-fold of the light amount of the non-to-be-corrected beams, thereby decreasing the light amount of the to-be-corrected beam.

Next, with reference to FIGS. 10 and 11, a description will be given of the image forming apparatus and its operation for adjusting image forming density.

Figure 10:
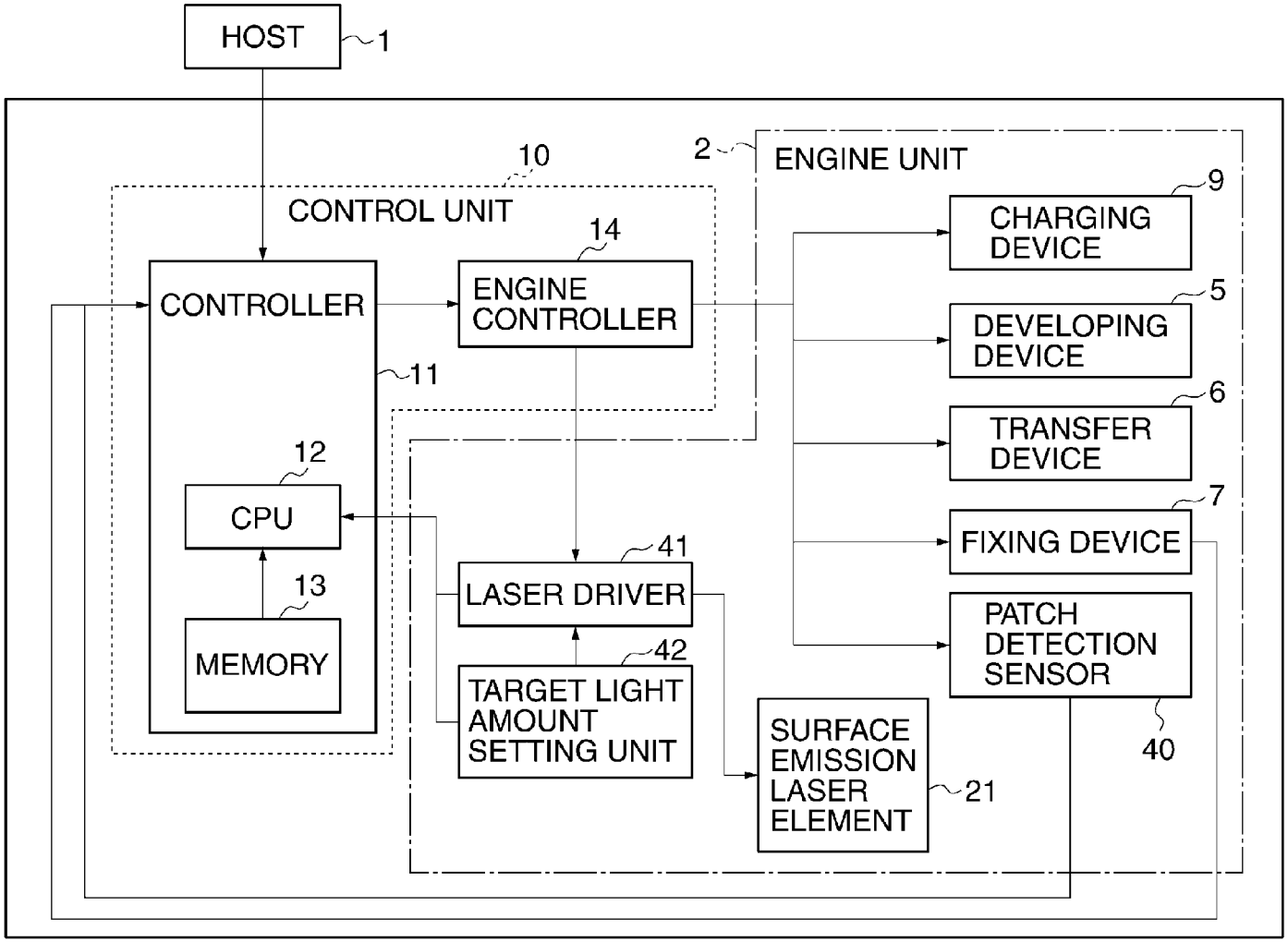
FIG. 10 is a block diagram schematically showing the construction of functional parts of the image forming apparatus.

FIG. 10 schematically shows, in block diagram, functional parts of the image forming apparatus.

As shown in FIG. 10, the image forming apparatus includes a host 1 for inputting an image signal, an engine unit 2 for performing image formation, and a control unit 10 for controlling the image formation.

The control unit 10 includes a controller 11 for controlling the entire apparatus, and an engine control unit 14 for controlling the engine unit 2. The controller 11 includes a CPU 12 for performing computations based on input information, and a memory 13 for storing amounts of correction for light amounts and target light amounts at main scan image heights, the number of sheets printed after the preceding density adjustment, and the like.

The engine unit 2 includes the image forming unit shown in FIG. 2 (only the developing device 5, transfer device 6, fixing device 7, charging device 9, and surface emission laser element 21 of the image forming unit are shown in FIG. 10), the patch detection sensor 40, a laser driver 41, and a target light amount setting unit 42.

Figure 11:
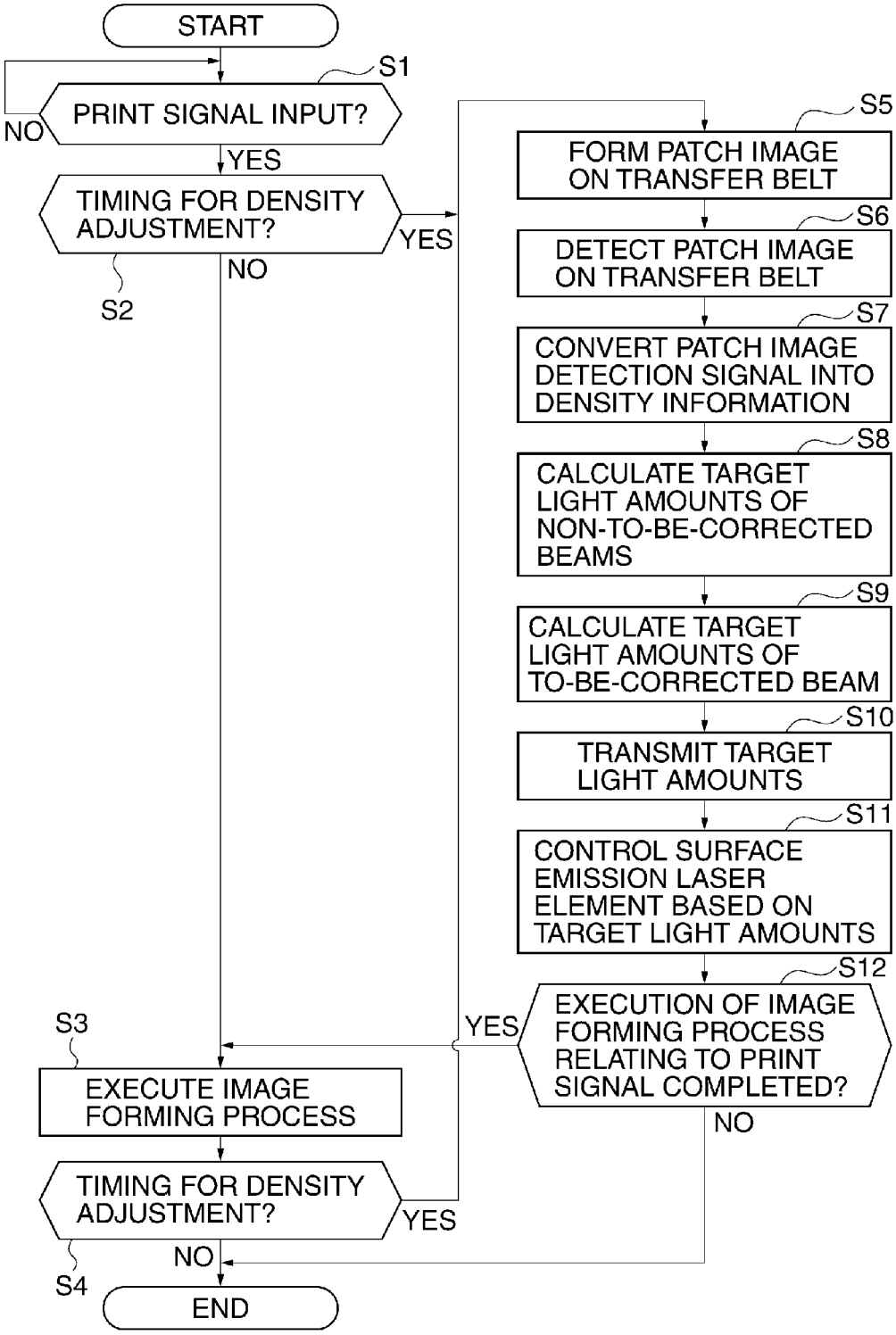
FIG. 11 is a flowchart showing the flow of a process performed by the image forming apparatus for adjusting image forming density.

FIG. 11 shows in flowchart the flow of a process performed by the image forming apparatus for adjusting the image forming density.

In the image forming density adjusting process, the CPU 12 of the controller 11 determines whether or not a print signal is input to the host 1 (step S1). If the answer to step S1 is YES, the CPU 12 determines whether or not input of power supply (e.g., power-on) is detected and also determines whether or not image formation is performed for the first time after the temperature in the fixing device 7 reaches e.g. 100 degree centigrade, thereby determining whether or not timing for the density adjustment is reached (step S2). If determined that the density adjustment timing is not reached (if NO to step S2), the flow proceeds to step S3.

In step S3, a control signal is sent from the CPU 12 to the engine control unit 14, and an image forming process is executed by the engine unit 2 under the control of the engine control unit 14. Next, the CPU 12 determines whether or not image formation has been performed on e.g. 100 sheets from the preceding density adjustment, thereby determining whether or not the density adjustment timing is reached (step S4). If the answer to step S4 is NO, the image forming density adjusting process is completed.

If determined in step S2 or S4 that the density adjustment timing is reached, the flow proceeds to step S5 where a density adjustment process is started.

In step S5, a control signal is sent from the CPU 12 to the engine control unit 14, and under the control of the engine control unit 14, a patch pattern (patch image) is formed on the intermediate transfer belt 62 by the engine unit 2 based on image data of patch pattern for density correction stored in the memory 13.

Next, in step S6, the patch detection sensor 40 detects the patch pattern formed on the intermediate transfer belt 62, and sends a detection signal to the CPU 12. The CPU 12 converts the received detection signal into density information (patch density) (step S7).

Next, the CPU 12 calculates a difference between the target density stored in the memory 13 and the detected patch density, and calculates target light amounts of the non-to-be-corrected beams (step S8).

In step S9, while referring to the amounts (values) of correction for light amount of the to-be-corrected beam stored in the memory 13, the CPU 12 multiplies the target light amounts of the non-to-be-corrected beams calculated in step S8 by the amount (value) of correction for light amount of the to-be-corrected beam at each main scan image height to thereby calculate target light amounts of the to-be-corrected beam at seven points of main scan image height, and calculates by interpolation amounts of correction for light amount at positions in the main scanning direction other than the seven points of main scan image height, thereby calculating target light amounts of the to-be-corrected beam at all the main scan image heights.

In step S10, the CPU 12 transmits to the target light amount setting unit 42 the target light amounts of the non-to-be-corrected beam calculated in step S8 and the target light amounts of the to-be-corrected beams calculated in step S9.

In step S11, the target light amount setting unit 42 rewrites register values indicating the target light amounts of the to-be-corrected beam at all the main scan image heights and rewrites register values indicating the target light amounts of the non-to-be-corrected beams. Based on the rewritten register values, the laser driver 41 controls the surface emission laser element 21 such that the beams become to have the target light amounts. Then, the density adjustment is completed.

In step S12, the CPU 12 determines whether or not the image forming process relating to the print signal input at the start of the density adjustment has been executed. If the answer to step S12 is NO, the flow proceeds to step S3 where image forming process is executed. On the other hand, if the image forming process has been executed (YES to step S12), the image forming density adjustment process is completed.

Next, a description will be given of advantageous effects achieved by the density adjustment (light amount correction) performed by the image forming apparatus of this embodiment. To this end, there is shown the degree of density unevenness produced in this embodiment where the light amount correction is performed in comparison with the degree of density unevenness produced in a first comparative example where no light amount correction is performed and the degree of density unevenness produced in a second comparative example where an amount of correction for eliminating density unevenness caused at one end of main scan image height is used for correction of light amounts at respective main scan image heights.

Figure 12:
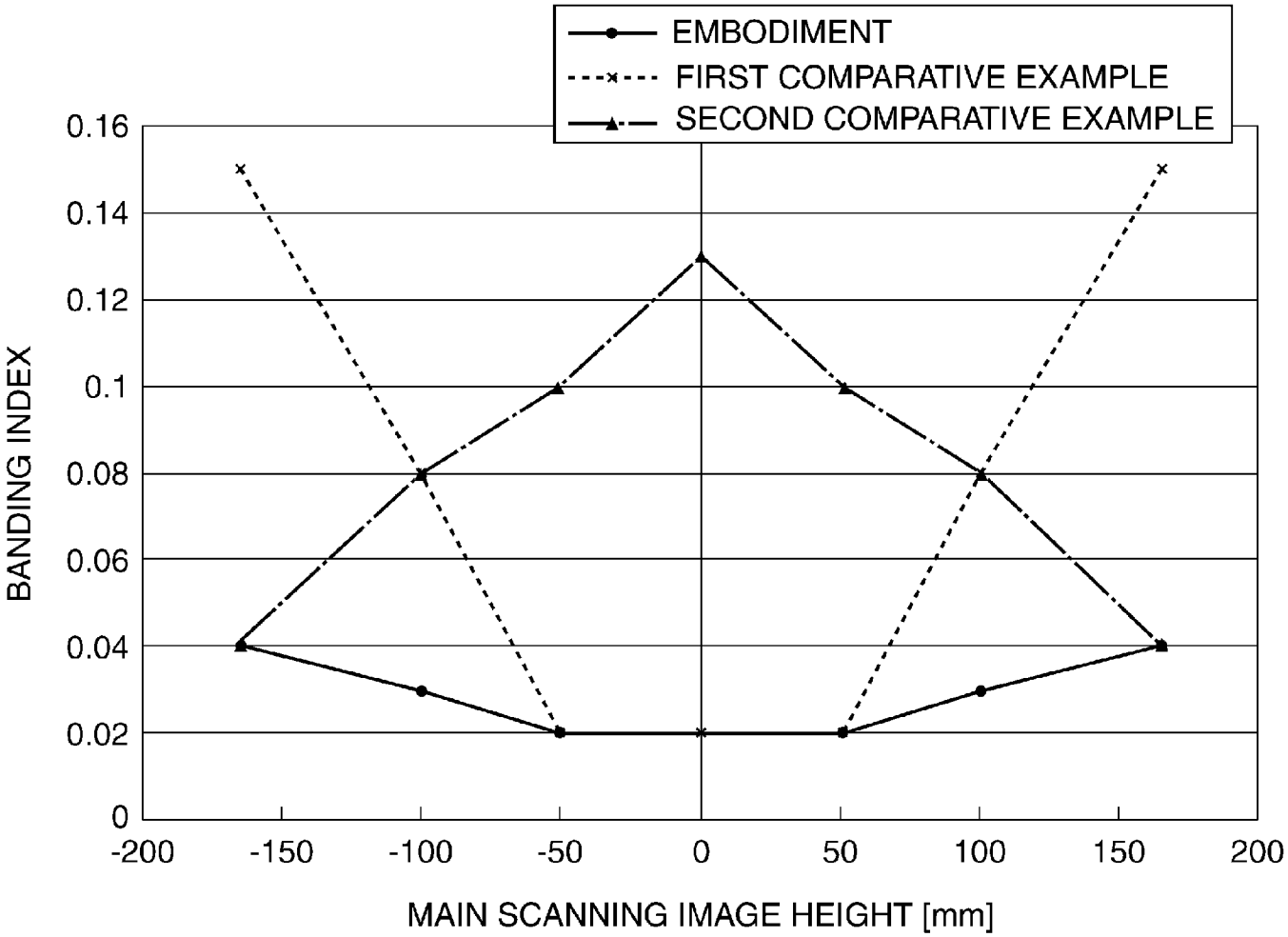
FIG. 12 is a graph showing a relationship between main scan image height and banding index.

FIG. 12 shows a relationship between main scan image height and banding index. In FIG. 12, the banding index representing the degree of density unevenness is taken along ordinate, and the main scan image height is taken along abscissa. A position where the main scan image height is 0 mm corresponds to the center of main scan image height, and positions where main scan image heights are +165 mm and −165 mm respectively correspond to the ends of main scan image height.

In FIG. 12, a bold polyline represents a relationship between main scan image height and banding index in this embodiment where the light amount correction is performed. This relationship illustrates that the banding index is less than 0.1 in the entire region of main scan image height. This indicates that it is possible to obtain an image with no density unevenness.

A dotted polyline represents a relationship between main scan image height and banding index in the first comparative example where light amount correction is not performed. This relationship illustrates that the banding index increases toward each end of main scan image height from the center of main scan image height. This indicates that at the ends of main scan image height, the sub-scanning interval between beams, Lab, is deviated from the ideal interval, and accordingly density unevenness is produced.

A polyline (shown by one-dotted chain line in FIG. 12) represents a relationship between main scan image height and banding index in the second comparative example where light amount corrections at respective main scan image heights are performed while using the correction amount for eliminating density unevenness caused at one end of main scan image height. This relationship illustrates that the banding index becomes less than 0.1 at the ends of main scan image height, but increases at the center of main image height, and accordingly density unevenness is produced.

According to this embodiment, light amounts of beams that expose each end portion of the photosensitive member are made different from light amounts of beams that expose the central portion of the photosensitive member, thereby suppressing a density difference between a toner image density at the central portion of the photosensitive member and a toner image density at each end portion of the photosensitive member.

Other Embodiments

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2012-169589, filed Jul. 31, 2012, which is hereby incorporated by reference herein in its entirety.

What is claimed is:

1. An image forming apparatus comprising:

a light source configured to emit a first beam that exposes a rotating photosensitive member and emit a second beam that exposes the photosensitive member at a position different from that exposed by the first beam in a direction of rotation of the photosensitive member;

a deflection unit configured to deflect the first and second beams emitted from said light source so that the first and second beams scan the photosensitive member;

a lens configured to guide the first and second beams deflected by said deflection unit to the photosensitive member;

an image forming unit configured to develop an electrostatic latent image formed on the photosensitive member by being exposed to the first and second beams into a toner image; and a control unit configured to control a light amount of the second beam based on an exposure position of the second beam in a main scanning direction of each of the first beam and the second beam scanning the photosensitive member to suppress a density of the toner image from changing, due to a distance between an exposure position of the first beam and an exposure position of the second beam varying according to a position in the main scanning direction.

2. The image forming apparatus according to claim 1, wherein said control unit controls the light amount of the second beam based on the distance between the exposure position of the first beam and the exposure position of the second beam changing according to the position in the main scanning direction, based on characteristics of the lens.

3. The image forming apparatus according to claim 1, wherein:

in a case where the lens guides the second beam to the photosensitive member so that the distance between the exposure positions of the first and second beams becomes greater at an end portion in the main scanning direction than at a central portion in the main scanning direction, and said control unit controls said light source so that the light amount becomes larger at the end portion than at the central portion.

4. The image forming apparatus according to claim 1, wherein:

in a case where the lens guides the second beam to the photosensitive member so that the distance between the exposure positions of the first and second beams becomes smaller at an end portion in the main scanning direction than at a central portion in the main scanning direction, and said control unit controls said light source so that the light amount becomes smaller at the end portion than at the central portion.

5. The image forming apparatus according to claim 1, wherein a position where the first beam enters and passes through the lens is closer to an optical axis of the lens than a position where the second beam passes through the lens.

6. A control apparatus for an image forming apparatus having a light source configured to emit a first beam that exposes a rotating photosensitive member and emit a second beam that exposes the photosensitive member at a position different from that exposed by the first beam in a direction of rotation of the photosensitive member, a deflection unit configured to deflect the first and second beams emitted from the light source so that the first and second beams scan the photosensitive member, a lens configured to guide the first and second beams deflected by the deflection unit to the photosensitive member, and an image forming unit for developing an electrostatic latent image formed on the photosensitive member by being exposed to the first and second beams into a toner image, the control apparatus comprising:

a control unit configured to control a light amount of the second beam based on an exposure position of the second beam in a main scanning direction of each of the first beam and the second beam scanning the photosensitive member to suppress a density of the toner image from changing, due to a distance between an exposure position of the first beam and an exposure position of the second beam varying according to a position in the main scanning direction.

7. The control apparatus according to claim 6, wherein said control unit controls the light amount of the second beam based on the distance between the exposure position of the first beam and the exposure position of the second beam changing according to the position in the main scanning direction, based on characteristics of the lens.

8. The control apparatus according to claim 6, wherein:

in a case where the lens guides the second beam to the photosensitive member so that the distance between the exposure positions of the first and second beams becomes greater at an end portion in the main scanning direction than at a central portion in the main scanning direction, and said control unit controls the light source such that the light amount becomes larger at the end portion than at the central portion.

9. The control apparatus according to claim 6, wherein:

in a case where the lens guides the second beam to the photosensitive member so that the distance between the exposure positions of the first and second beams becomes smaller at an end portion in the main scanning direction than at a central portion in the main scanning direction, and said control unit controls the light source so that the light amount becomes smaller at the end portion than at the central portion.

10. The control apparatus according to claim 6, wherein a position where the first beam enters and passes through the lens is closer to an optical axis of the lens than a position where the second beam passes through the lens.

* * * * *